US006983512B2

(12) United States Patent
De Oliveira

(10) Patent No.: US 6,983,512 B2
(45) Date of Patent: Jan. 10, 2006

(54) MOVABLE DOOR MOUNTING ASSEMBLY WITH TROLLEY LOCKING STRUCTURE

(75) Inventor: Egidio Lucas De Oliveira, High Point, NC (US)

(73) Assignee: Masco Corporation, Taylor, MI (US)

( * ) Notice: Subject to any disclaimer, the term of this patent is extended or adjusted under 35 U.S.C. 154(b) by 460 days.

(21) Appl. No.: 10/200,903

(22) Filed: Jul. 23, 2002

(65) Prior Publication Data

US 2004/0016080 A1 Jan. 29, 2004

(51) Int. Cl.
*E05D 13/04* (2006.01)

(52) U.S. Cl. ..... 16/97; 16/87 R; 16/91; 49/449

(58) Field of Classification Search ..... 16/97, 16/87 R, 91, 102, 96 R
See application file for complete search history.

(56) References Cited

U.S. PATENT DOCUMENTS 3,826,044 A * 7/1974 Armstrong ..... 16/91
3,829,929 A * 8/1974 Foltz et al. ..... 16/97
3,925,933 A * 12/1975 Reuter ..... 16/87 R
3,951,076 A * 4/1976 Knudsen et al. ..... 16/98
4,872,287 A * 10/1989 Block ..... 16/87 R
5,647,423 A * 7/1997 Harms ..... 16/87 R
6,209,171 B1 4/2001 Pelletier et al.
6,374,456 B1 * 4/2002 Fort et al. ..... 16/96 R
6,463,625 B2 * 10/2002 Mittag ..... 16/97
6,588,482 B2 * 7/2003 Wright ..... 16/91

FOREIGN PATENT DOCUMENTS

GB 2236134 A * 3/1991

* cited by examiner

*Primary Examiner*—Brian E. Glessner
*Assistant Examiner*—Christopher J. Boswell
(74) *Attorney, Agent, or Firm*—Carlson, Gaskey & Olds

(57) ABSTRACT

A movable door mounting assembly includes a stud assembly and a trolley assembly having a spring-biased cam piece that pivots between a normal position, which allows the trolley assembly to move freely on the track, and a locked position, which causes a locking surface on the cam piece to frictionally engage with a top surface of the track and hold the trolley assembly in place while the door is being hung. A catch in the stud assembly engages with the cam piece when the mounting assembly is fully assembled. Inserting the stud assembly into the trolley assembly, releases the cam piece from its locked position and, at the same time, positions the catch so that it engages with the cam piece when the door is hung.

17 Claims, 6 Drawing Sheets

MOVABLE DOOR MOUNTING ASSEMBLY WITH TROLLEY LOCKING STRUCTURE

TECHNICAL FIELD

The present invention relates to movable door installations and more particularly to mounting assemblies for movable door installations.

BACKGROUND OF THE INVENTION

Movable door mounting structure are used in both sliding door installations and folding door installations. Both installations allow the door to move along a horizontal track mounted at the top of a door opening, with the door being suspended from the track via the mounting assembly. Sliding door installations usually include two separate mounting structures, one at each end of the door, while folding door installations have a hinge connecting an outer door panel with a pivoting door panel and a movable mounting structure attached to the pivoting door panel.

The mounting structure usually includes two cooperating assemblies: a trolley assembly inserted into the horizontal track and studs mounted to the top of the door. When the door is inserted into the door opening, the studs engage with the trolley assembly to suspend the door from the track.

Because the trolley assembly has wheels that roll on the track, a user may have to chase the loose trolley with the stud while positioning the door in the door opening. This problem is aggravated by the bulk of the door, which makes it difficult to align the stud with the moving trolley assembly. Some users solve this problem by securing the trolley to the track with tape before inserting the stud, but removing the tape is difficult once the door is hung in the door opening. As a result, any tape residue on the track or the trolley prevents the trolley from moving smoothly.

There is a desire for a movable door mounting structure that makes it easier to attach a movable door panel into a door opening.

SUMMARY OF THE INVENTION

Accordingly, one embodiment of the invention is directed to a movable door mounting assembly that has a mounting structure movably supported on a track disposed in a door opening. A movable door panel is suspended from the track by the mounting structure, which includes a stud assembly and a trolley assembly. The trolley assembly includes a spring-biased cam piece that pivots between a normal position, which allows the trolley assembly to move freely on the track, and a locked position, which causes a locking surface on the cam piece to frictionally engage with a top surface of the track and hold the trolley assembly in place.

The stud assembly includes a catch designed to engage with the cam piece when the mounting assembly is fully assembled. During door mounting, a user pivots the cam piece into the locking position, preventing the trolley assembly from moving while the user inserts the stud assembly. When the door panel is pushed upward to engage the stud assembly with the trolley assembly, the upward movement releases the cam piece from its locked position and, at the same time, positions the catch so that it engages with the cam piece when the door panel is released and allowed to move back downward.

As a result, the invention provides a simple locking structure that makes it easier to connect the trolley assembly with the stud assembly to hang a movable door panel.

Further, the automatic releasing feature of the locking structure eliminates the need to remove any components retaining the trolley assembly once the door panel has been hung.

DETAILED DESCRIPTION OF THE EMBODIMENTS

Figure 1:
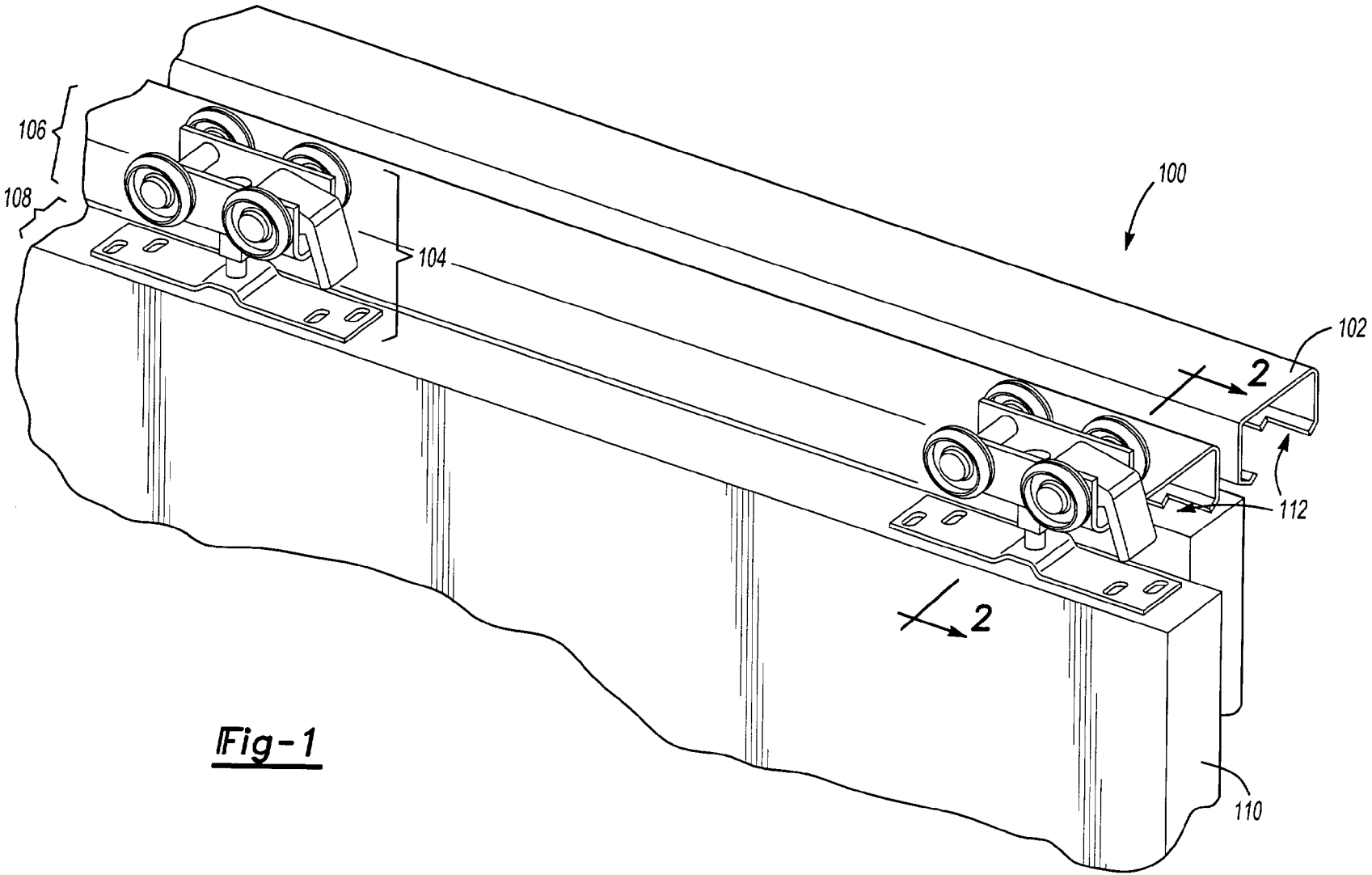
FIG. 1 is a perspective view of one embodiment of a door mounting assembly according to one embodiment of the invention.

FIG. 1 is an example of a twin sliding door installation having a door mounting assembly 100 according to one embodiment of the invention. Note that the door mounting assembly 100 can also be applied to folding doors. In one embodiment, the door mounting assembly 100 includes a track 102 and a mounting structure 104. The mounting structure 104 includes a trolley assembly 106 and a stud assembly 108, allowing a door 110 to be mounted within a door opening. The track 102 is mounted in a doorway opening along a desired travel path for the mounting structure 104. The mounting structure 104 is movable within the track 102, allowing the door 110 to slide and/or pivot. In the embodiment shown in FIG. 1, two mounting structures 104 are inserted into the track 102 through a gap 112 at the end of the track 102.

Figure 2:
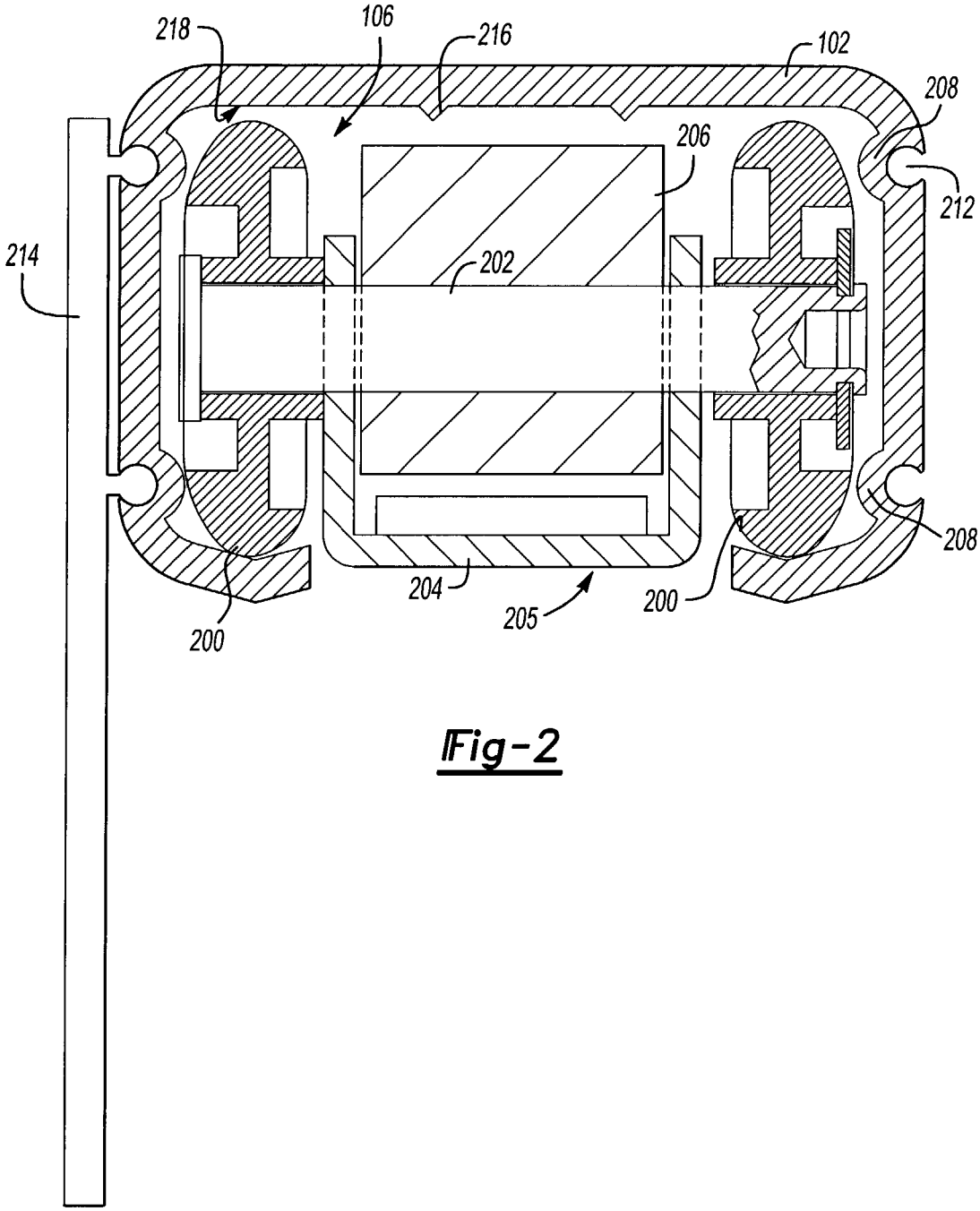
FIG. 2 is a section view taken along line 2–2' of the door mounting assembly shown in FIG. 1.

FIG. 2 is a section view of the track 102 and the trolley assembly 106 taken along line 2–2' in FIG. 1. In the illustrated embodiment, four wheels 200 are mounted to two parallel axles 202 that are held by a center plate 204. The wheels 200, axles 202 and center plate 204 together form a carriage 205. A cam piece 206 is mounted to at least one of the axles 202 to form the trolley assembly 106. The cam piece 206 is rotatable about the axle 202. Note that the carriage 205 is not limited to the structure shown in FIG. 2, but can incorporate any configuration that allows the trolley assembly 106 to move smoothly along the track 102.

The door mounting assembly 100 may incorporate any track 102 structure known in the art. Alternatively, the track 102 may incorporate several features that improve performance of the mounting assembly 100. As shown in FIG. 2, the track 102 may include longitudinal guides 208 that extend along the length of side inner surfaces of the track 102 to guide the trolley wheels 200 and prevent the ends of the axles 202 from scraping against the sides of the track 102. The guides 208 can also increase the rigidity of the track 102. Optional grooves 212 may be formed in the guides 208 so that a track cover 214 can be attached to the side outer surface of the track 102, if desired. Longitudinal ribs 216 may also be formed on an inner surface, such as a top inner surface 218, of the track 102 to provide added friction for the cam piece 206 to hold the trolley assembly 206 in place, as will be described in greater detail below. Other frictional surfaces may be formed or attached to the track instead of the ribs 216 on the inner surface 218 without departing from the scope of the invention. Further, although the embodiment shown in the Figures show the frictional surface on the top inner surface 218 of the track 102, the frictional texture may be disposed on or attached to the side inner surfaces of the track 102 instead of or in addition to the top inner surface 218. Also, the frictional texture may, if desired, be formed in a separate component that is attached to the track 102; this allows the frictional texture to be formed in a material that is different from the track material.

Figure 3:
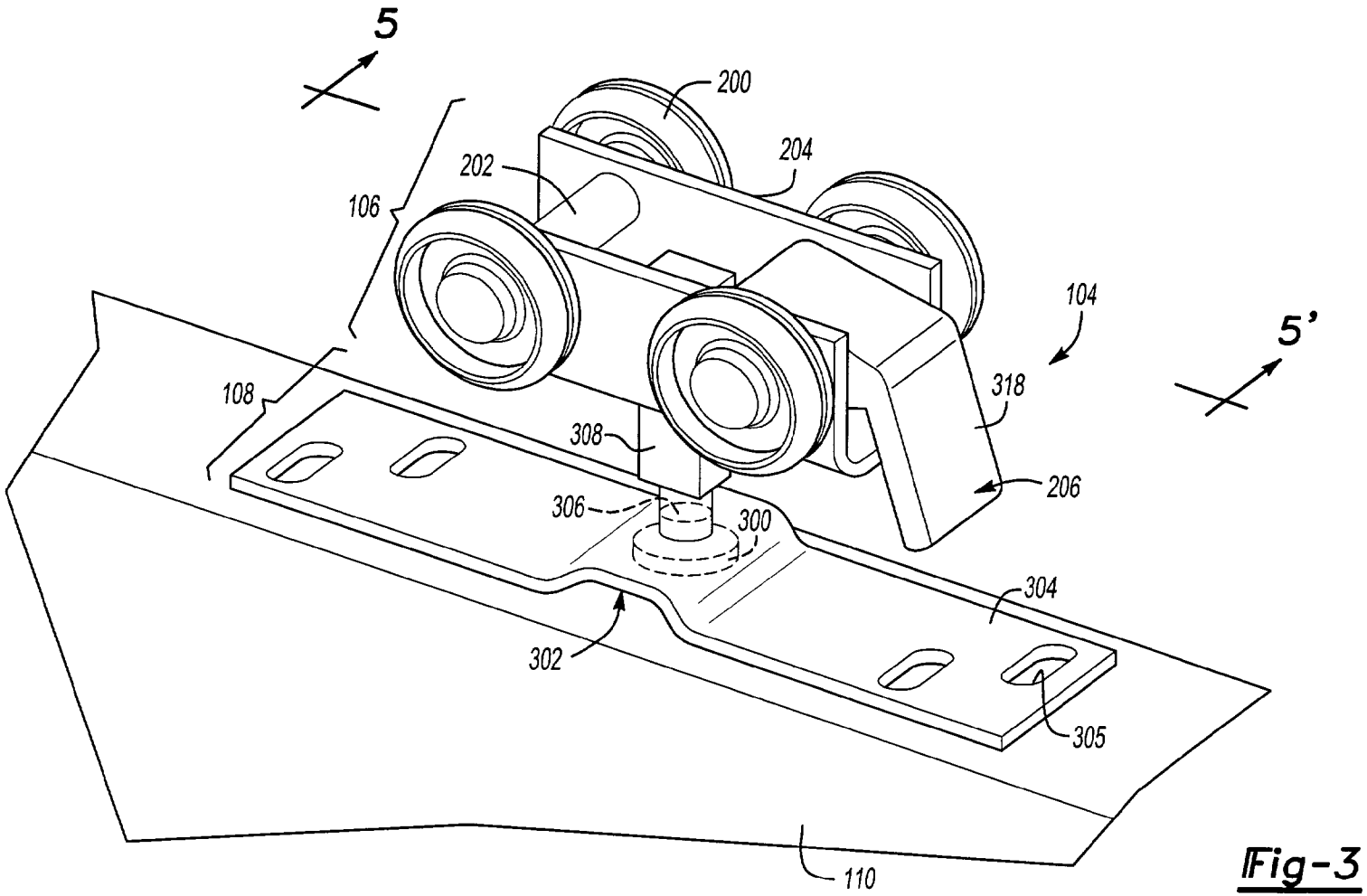
FIG. 3 is a perspective view of a portion of a mounting structure in the door mounting assembly according to one embodiment of the invention.
Figure 4:
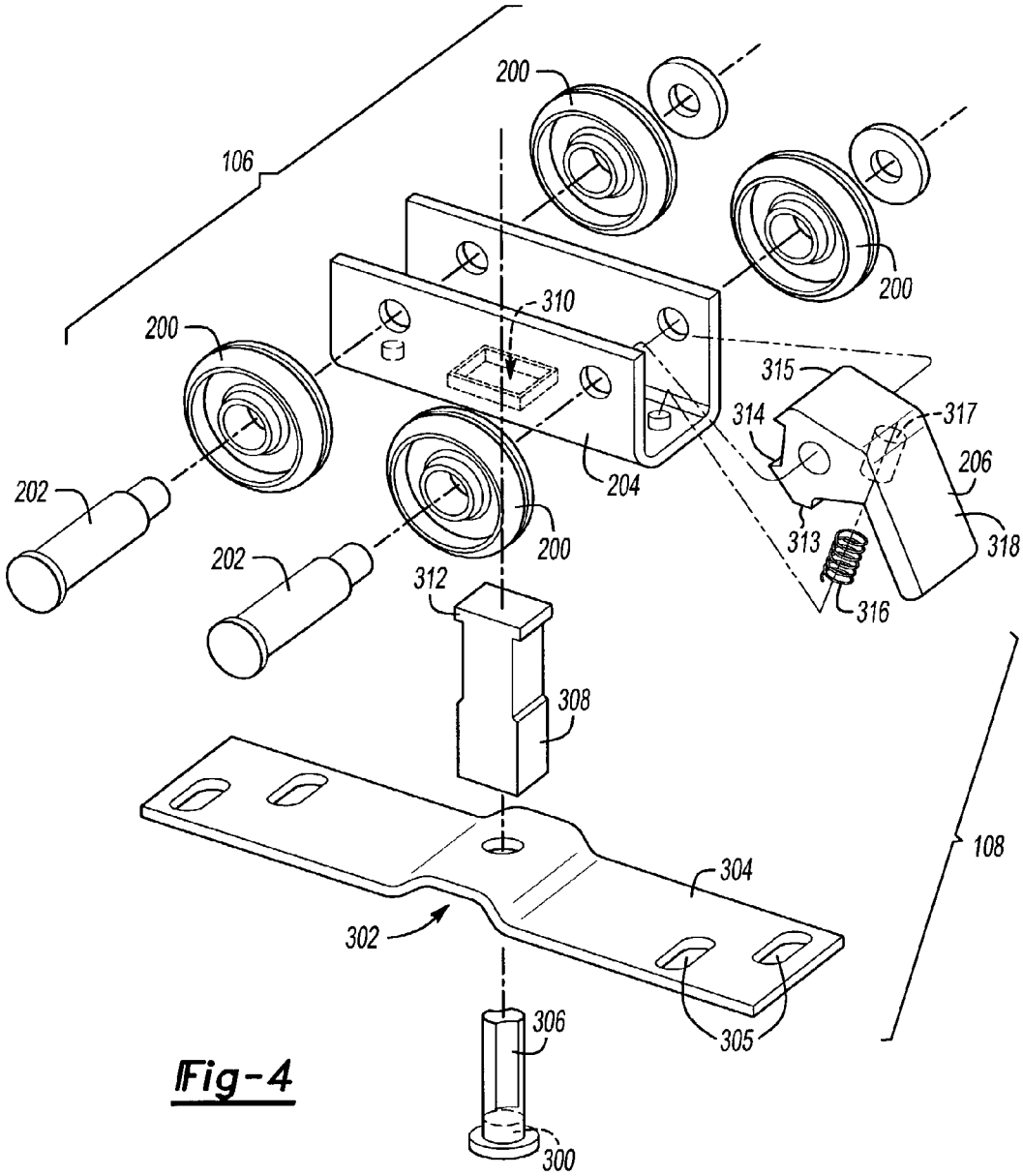
FIG. 4 is an exploded view of the structure shown in FIG. 3.

Referring to FIGS. 3 and 4, the stud assembly 108 is designed to be attached to the door 110 and to couple with the trolley assembly 106. The stud assembly 108 includes a stud head 300 held in a pocket 302 of a door plate 304, which is designed to be attached to the door 110. The door plate 304 may include one or more slots 305 to accommodate screws or other similar attachment structures (not shown) attaching the door plate 304 to the top of the door 110. The stud head 300 supports an adjustable stud 306 via a threaded or other engagement structure, and a movable catch 308 is movably attached to the adjustable stud 306. The catch 308 can move up and down the adjustable stud 306 freely. In one embodiment, the catch 308 extends through a hole 310 in the center plate 204 of the trolley assembly 106 and has a stud catch surface 312 designed to engage with the cam piece 206.

As noted above, the cam piece 206 is rotatable about the axle 202 holding it to the trolley assembly 106. The cam piece 206 also has three cam surfaces: a bearing surface 313, a cam catch surface 314, and a locking surface 315. The cam piece 206 is also biased by a spring 316 placed in a hole 317 in the cam piece 206. A lever portion 318 on the cam piece 206 allows a user to pivot the cam piece 206 with the fingers. If there are no forces applied to the cam piece 206, the spring 316 biases the cam piece 206 so that the bearing surface 313 contacts the center plate 204.

Figure 5A:
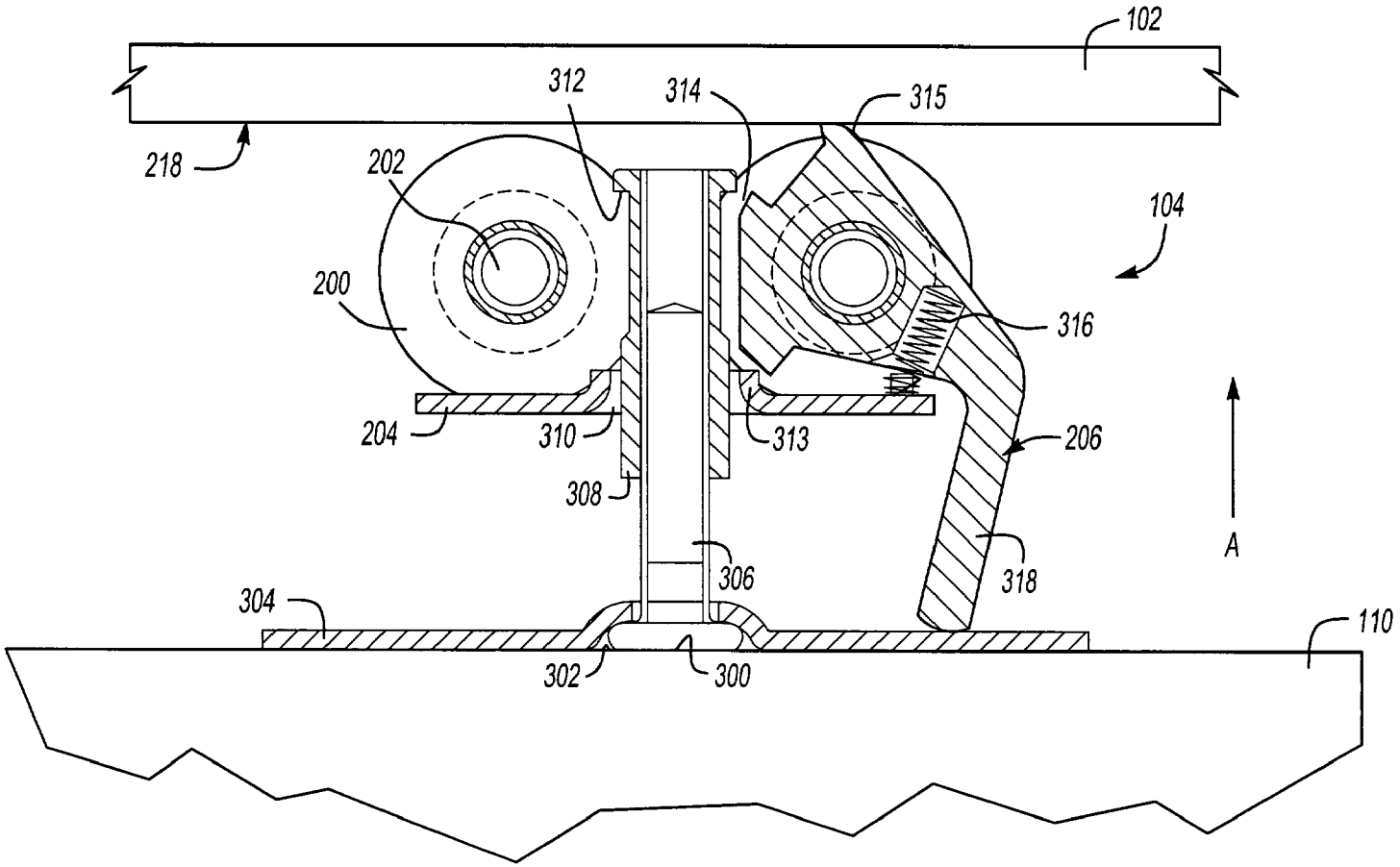
FIGS. 5*a* and 5*b* are section views taken along line 5–5' of the mounting structure shown in FIG. 3 at different stages of assembly.
Figure 5B:
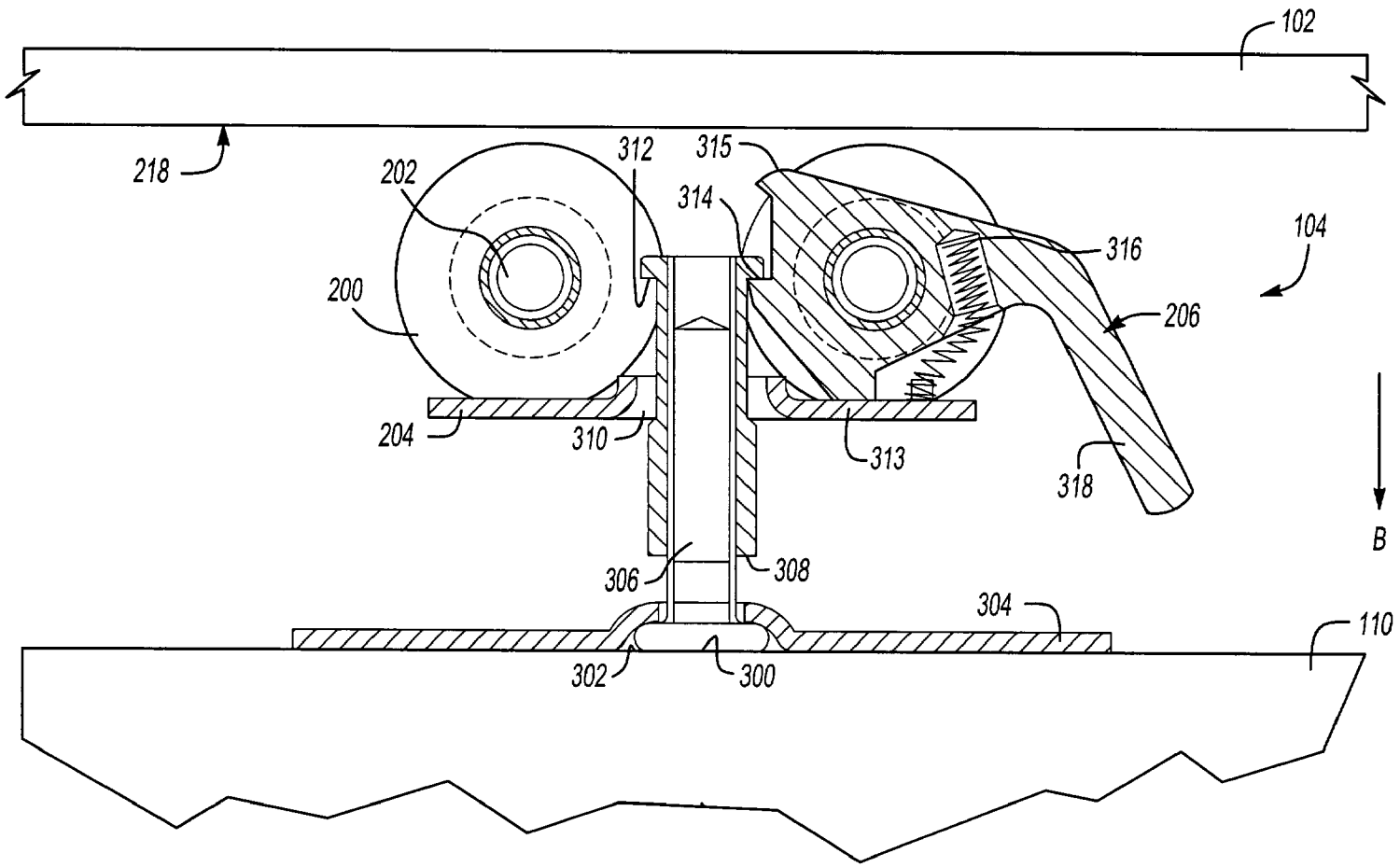

FIGS. 5*a* and 5*b* illustrate the operation of the inventive door mounting assembly 100 at different stages of engagement. For clarity, the Figures show an assembly 100 having one cam piece 206; however, a preferred embodiment of the invention has two cam pieces 206, one attached to each axle 2002. Initially, the trolley assembly 106 is placed in the track 102 and the lever 318 on the cam piece 206 is squeezed downward against the biasing force of the spring 316 until the locking surface 315 engages with the top inner surface 218 of the track 102. The friction between the locking surface 315 and the track surface 218 immobilizes the trolley assembly 106 on the track 102. If the track surface 218 has longitudinal ribs 216, the ribs 216 help create a better grip between the locking surface 315 on the cam piece and the track surface 218.

Next, as shown in FIG. 5*a*, the user engages the stud assembly 108 with the trolley assembly 106 by raising the door 110, with the stud assembly 108 attached, so that the catch 308 extends through the hole 310 in the trolley assembly 106. As the door 110, and therefore the stud assembly 108, move upward as shown by arrow A, the stud catch surface 312 moves above the cam catch surface 314. The position and shape of the cam piece 206 allows the catch 308 to move freely past the cam piece 206 while the cam piece 206 is in the locked position. At the same time, the door plate 304 pushes against the lever 318, overcoming the friction force between the locking surface 315 and the track surface 218. The biasing force of the spring 310 allows the cam piece 206 to rotate back to its normal position, when the door 110 is released and allowed to drop down via gravity.

As shown in FIG. 5*b*, however, the stud catch surface 312 prevents the catch 308 from slipping back out of the hole 310 in the trolley assembly 206 when the door drops. Instead, the stud catch surface 312 engages with the cam catch surface 314 as the stud assembly 108 moves downward, as indicated by arrow B. When the cam piece 206 returns to its normal position, with the bearing surface 313 contacting the center plate 204, the engagement between the stud catch surface 312 and the cam catch surface 314 supports the door 310 as it hangs from the trolley assembly 206. The rotation of the cam piece 206 also disengages locking surface 315 and the track surface 218, automatically releasing the trolley assembly 106 and allowing it to move freely in the track 102. The adjustable stud 306 may be rotated within the catch 308 by the user to fine-tune the door's position.

To remove the door 110, the steps in FIGS. 5*a* and 5*b* are simply reversed. Lifting the door 110 while squeezing the lever 318 releases the catch 308 and disengages the cam catch surface 314 away from the stud catch surface 312. Squeezing the lever 318 also locks the trolley assembly 106 on the track 102, holding it in place while the door 110 is being removed. Maintaining the separation between the two surfaces 312, 314 allows the stud assembly 310 to drop out of the trolley assembly 206, releasing the door 110. At the same time, the locking surface 315 engages with the track surface 318, locking the trolley assembly 216 on the track 102.

As a result, the inventive structure makes it easier to align different portions of the door mounting assembly without requiring the user to chase the trolley assembly along the track or tape the trolley assembly to the track. Instead, the invention integrates a trolley locking structure that is easily accessible, simple to manufacture, and that automatically disengages when the door is hung in place. Further, because the inventive door mounting assembly relies on components (e.g., the cam piece 206 an catch 308) having larger bearing surfaces than currently known structures, the invention does not need to rely on expensive high-strength materials to create a reliable mounting assembly.

It should be understood that various alternatives to the embodiments of the invention described herein may be employed in practicing the invention. It is intended that the following claims define the scope of the invention and that the method and apparatus within the scope of these claims and their equivalents be covered thereby.

What is claimed is:

1. A trolley assembly for a mounting structure in a movable door mounting assembly having a track, comprising:

a carriage that moves the trolley assembly along the track; and a cam piece coupled to the carriage and pivotable between a normal position and a locking position, wherein the cam piece includes a locking surface that engages with a surface of the track in the locking position and releases from the surface of the track in the normal position.

2. The trolley assembly of claim 1, wherein the carriage comprises:

at least one pair of wheels disposed substantially parallel to each other; and at least one axle coupled to said at least one pair of wheels, wherein the cam piece is pivotable about said at least one axle.

3. The trolley assembly of claim 2, further comprising a center plate disposed between said at least one pair of wheels and supporting said at least one axle.

4. The trolley assembly of claim 3, wherein the cam piece further includes a bearing surface that contacts the center plate when the cam piece is in the normal position.

5. The trolley assembly of claim 1, further comprising an elastic member that biases the cam piece in the normal position.

6. A mounting structure for a moveable door mounting assembly having a track, comprising:

a stud assembly designed to be attached to a door, the stud assembly comprising a catch having a stud catch surface; and a stud that supports the catch and couples the catch to the door; and a trolley assembly that engages with the stud assembly, the trolley assembly comprising a carriage that moves the trolley assembly along the track, the carriage having a center plate; and a cam piece coupled to the carriage and pivotable between a normal position and a lacking position, wherein the cam piece includes a locking surface that engages with a surface of the track in the locking position and releases from the surface of the track in the normal position, a bearing surface that contacts the center plate when the cam piece is in the normal position, and a cam catch surface that engages with the stud catch surface when the door is mounted.

7. The mounting structure of claim 6, wherein the stud is an adjustable stud.

8. The mounting structure of claim 6, wherein the carriage further comprises:

at least one pair of wheels disposed substantially parallel to each other; and at least one axle coupled to said at least one pair of wheels and the center plate, wherein the cam piece is pivotable about said at least one axle.

9. The mounting of claim 6, wherein the carriage further comprises an elastic member that biases the cam piece in the normal position.

10. A movable door mounting assembly, comprising:

a longitudinal track having a top inner surface, at least two side inner surfaces, and at least two side outer surfaces;

a stud assembly designed to be attached to a door, the stud assembly comprising a catch having a stud catch surface; and a stud that supports the catch and couples the catch to the door; and a trolley assembly that engages with the stud assembly, the trolley assembly comprising a carriage that moves the trolley assembly along the track, the carriage having a center plate, at least one pair of wheels disposed substantially parallel to each other and at least one axle coupled to said at least one pair of wheels and the center plate; and a cam piece coupled to the carriage and pivotable about said at least one axle between a normal position and a locking position, wherein the cam piece includes a locking surface that engages with a surface of the track in the locking position and releases from the surface of the track in the normal position, a bearing surface that contacts the center plate when the cam piece is in the normal position, and a cam catch surface that catches the stud catch surface when the door is mounted.

11. The movable door mounting assembly of claim 10, wherein the track comprises a longitudinal guide disposed on at least one side inner surface.

12. The movable door mounting assembly of claim 10, wherein the track comprises a groove disposed on at least one side outer surface.

13. The movable door mounting assembly of claim 10, wherein the track comprises a frictional pattern on at least one of the top inner surface and the side inner surface.

14. The movable door mounting assembly of claim 13, wherein the frictional pattern is integrally formed into said at least one of the top inner surface and the side inner surface.

15. The movable door mounting assembly of claim 13, wherein the frictional pattern is formed on a separate piece that is attached to said at least one of the top inner surface and the side inner surface.

16. The movable door mounting assembly of claim 13, wherein the frictional pattern is at least two longitudinal ribs.

17. The movable door mounting assembly of claim 10, wherein the carriage further comprises an elastic member that biases the cam piece in the normal position.

* * * * *

UNITED STATES PATENT AND TRADEMARK OFFICE

CERTIFICATE OF CORRECTION

PATENT NO. : 6,983,512 B2
DATED : January 10, 2006
INVENTOR(S) : De Oliveira

It is certified that error appears in the above-identified patent and that said Letters Patent is hereby corrected as shown below:

Column 5,
Line 19, "lacking" should read -- locking --.

Signed and Sealed this

Fourth Day of April, 2006

JON W. DUDAS
*Director of the United States Patent and Trademark Office*